US010777152B2

(12) United States Patent
Kang

(10) Patent No.: US 10,777,152 B2
(45) Date of Patent: Sep. 15, 2020

(54) DRIVING METHOD AND DRIVING DEVICE FOR DISPLAY PANEL, AND DISPLAY DEVICE

(71) Applicant: HKC CORPORATION LIMITED, Shenzhen, Guangdong (CN)

(72) Inventor: Zhicong Kang, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 14 days.

(21) Appl. No.: 16/313,479

(22) PCT Filed: Dec. 6, 2018

(86) PCT No.: PCT/CN2018/119562
§ 371 (c)(1),
(2) Date: Dec. 27, 2018

(87) PCT Pub. No.: WO2020/093499
PCT Pub. Date: May 14, 2020

(65) Prior Publication Data

US 2020/0143760 A1 May 7, 2020

(30) Foreign Application Priority Data

Nov. 5, 2018 (CN) ..... 2018 1 1308708

(51) Int. Cl.
*G09G 3/36* (2006.01)
*G09G 3/20* (2006.01)
*G09G 3/00* (2006.01)

(52) U.S. Cl.
CPC ..... *G09G 3/3607* (2013.01); *G09G 3/006* (2013.01); *G09G 3/2003* (2013.01); *G09G 2300/0447* (2013.01); *G09G 2310/02* (2013.01)

(58) Field of Classification Search
CPC ..... G09G 2300/0447; G09G 2310/02; G09G 2320/028; G09G 2320/0673; G09G 2320/068; G09G 2320/0686; G09G 2360/16; G09G 3/006; G09G 3/2003; G09G 3/3607
See application file for complete search history.

(56) References Cited

U.S. PATENT DOCUMENTS

2009/0066819 A1* 3/2009 Ando ..... G06T 5/009 348/254
2013/0322746 A1* 12/2013 Cote ..... G06T 1/20 282/163

(Continued)

*Primary Examiner* — Tony O Davis

(57) ABSTRACT

In the method and device of driving display panel, and display device provided in the embodiment of the present disclosure, the display panel is divided into n sub-regions, and an average gray scale value of original pixel cells in each sub-region is determined, a gray scale threshold value range corresponding to the sub-region is determined according to the average gray scale value of the sub-region when the average gray scale value is greater than a preset gray scale threshold value, a ratio of the total number of original pixel cells in the gray scale threshold value range to the total number of original pixel cells contained in the corresponding sub-region is determined, and gamma value of original pixel cell in the corresponding sub-region according to the ratio and a preset gamma value conversion relationship is reset.

18 Claims, 6 Drawing Sheets

(56) References Cited

U.S. PATENT DOCUMENTS

| | | | | |
|---|---|---|---|---|
| 2013/0329997 | A1* | 12/2013 | Webb | G06T 5/007 382/167 |
| 2017/0274690 | A1* | 9/2017 | Ukishima | B41J 29/38 |
| 2019/0251929 | A1* | 8/2019 | Fossati | H04N 9/643 |

* cited by examiner

| | | | | |
|---|---|---|---|---|
| ⋯⋯⋯⋯ ⋮ | ⋮ | ⋮ | ⋮ | ⋯⋯⋯ ⋮ |
| ⋯⋯⋯⋯ | F(x-1, y-1) | F(x, y-1) | F(x+1, y-1) | ⋯⋯⋯ |
| ⋯⋯⋯⋯ | F(x-1, y) | F(x, y) | F(x+1, y) | ⋯⋯⋯ |
| ⋯⋯⋯⋯ | F(x-1, y+1) | F(x, y+1) | F(x+1, y+1) | ⋯⋯⋯ |
| ⋮ ⋯⋯⋯ | ⋮ | ⋮ | ⋮ | ⋮ ⋯⋯⋯ |

FIG. 10

| In the various sub-regions n, Ave_Gn | In the sub-regions, Number of Ave_Gn± X(X=10 is preferably recommended)≥Y% (Y=60% is preferably recommended) | In the various sub-regions n, positive viewing angle Gamma |
|---|---|---|
| 185≤Ave_Gn≤195 | 180≤ Ave_Gn±10≤200 | 2.15 |
| 195≤Ave_Gn≤205 | 190≤ Ave_Gn±10≤210 | 2.10 |
| 205≤Ave_Gn≤215 | 200≤ Ave_Gn±10≤220 | 2.05 |
| 215≤Ave_Gn≤225 | 210≤ Ave_Gn±10≤230 | 2.00 |
| 225≤Ave_Gn≤235 | 220≤ Ave_Gn±10≤240 | 1.95 |
| 235≤Ave_Gn≤245 | 230≤ Ave_Gn±10≤250 | 1.90 |
| 245≤Ave_Gn≤255 | 240≤ Ave_Gn±10≤260 | 1.850 |

FIG. 11

| In the various sub-regions n, Ave_Rn | In the sub-regions, Number of Ave_Rn± X(X=10 is preferably recommended)≥Y% (Y=60% is preferably recommended) | In the various sub-regions n, positive viewing angle Gamma (Z=0.5 is preferably recommended) |
|---|---|---|
| 185≤Ave_Rn≤195 | 180≤ Ave_Rn±10≤200 | R_gamma-Z |
| 195≤Ave_Rn≤205 | 190≤ Ave_Rn±10≤210 | R_gamma-2Z |
| 205≤Ave_Rn≤215 | 200≤ Ave_Rn±10≤220 | R_gamma-3Z |
| 215≤Ave_Rn≤225 | 210≤ Ave_Rn±10≤230 | R_gamma-4Z |
| 225≤Ave_Rn≤235 | 220≤ Ave_Rn±10≤240 | R_gamma-5Z |
| 235≤Ave_Rn≤245 | 230≤ Ave_Rn±10≤250 | R_gamma-6Z |
| 245≤Ave_Rn≤255 | 240≤ Ave_Rn±10≤260 | R_gamma-7Z |

FIG. 12

| In the various sub-regions n, Ave_Bn | In the sub-regions, Number of Ave_Bn± X(X=10 is preferably recommended)≥Y% (Y=60% is preferably recommended) | In the various sub-regions n, Rn positive viewing angle Gamma (Z=0.5 is preferably recommended) |
|---|---|---|
| 185≤Ave_Bn≤195 | 180≤ Ave_Bn±10≤200 | B_gamma-Z |
| 195≤Ave_Bn≤205 | 190≤ Ave_Bn±10≤210 | B_gamma-2Z |
| 205≤Ave_Bn≤215 | 200≤ Ave_Bn±10≤220 | B_gamma-3Z |
| 215≤Ave_Bn≤225 | 210≤ Ave_Bn±10≤230 | B_gamma-4Z |
| 225≤Ave_Bn≤235 | 220≤ Ave_Bn±10≤240 | B_gamma-5Z |
| 235≤Ave_Bn≤245 | 230≤ Ave_Bn±10≤250 | B_gamma-6Z |
| 245≤Ave_Bn≤255 | 240≤ Ave_Bn±10≤260 | B_gamma-7Z |

FIG. 13

DRIVING METHOD AND DRIVING DEVICE FOR DISPLAY PANEL, AND DISPLAY DEVICE

CROSS-REFERENCE TO RELATED APPLICATION

This application is the PCT Application No. PCT/CN2018/119562 for entry into US national phase with an international filing date of Dec. 6, 2018 designating US, now pending, and claims priority to Chinese Patent Application No. 201811308708.8, filed with China National Intellectual Property Administration on Nov. 5, 2018, and titled "driving method and driving device for display panel, and display device", the content of which is incorporated herein by reference in entirety.

TECHNICAL FIELD

The present disclosure relates to the technology field of display, and more particularly to a driving method and a driving device for display panel, and a display device.

BACKGROUND

The statements herein provide only background information related to the present disclosure without necessarily constituting the prior art. VA (Vertical Alignment) technology type liquid crystal panel or IPS (In-plane Switching) type liquid crystal panel are usually used in the existing large-size liquid crystal display panel, the VA type liquid crystal panel technology has the advantages of higher production efficiency and lower manufacturing cost as compared to the IPS type liquid crystal panel.

However, a brightness of the existing VA type liquid crystal panel technology at a large viewing angle is increased rapidly with the increase of driving voltage, such that the image quality of VA type liquid crystal panel of the large viewing angle is worsened, and the experience of the user is greatly influenced.

SUMMARY

An object of the present disclosure is to provide a driving method for a display panel which solves technical problems including but are not limited to achieving the purpose of reducing a color cast of the display panel.

The technical solution to be solved by the embodiment of the present disclosure is to provide a driving method for display panel, including:

dividing the display panel into n sub-regions and calculating an average gray scale value of original pixel cells in each sub-region, wherein n is an integer greater than 1;

determining a gray scale threshold value range corresponding to the sub-region according to the average gray scale value of the sub-region, when the average gray scale value is greater than a preset gray scale threshold value;

calculating a ratio of the total number of original pixel cells in the gray scale threshold value range to the total number of original pixel cells contained in the corresponding sub-region; and resetting gamma value of original pixel cell in the corresponding sub-region according to the ratio and a preset gamma value conversion relationship.

Embodiments of the present disclosure further provide a driving device for display panel, including:

a statistic circuit configured to divide the display panel into n sub-regions and to determine an average gray scale value of original pixel cells in each sub-region, wherein the original pixel cell is any one selected from a group consisting of a red pixel cell, a green pixel cell and a blue pixel cell, and where n is an integer greater than 1;

an range setting circuit configured to determine a gray scale threshold value range corresponding to the sub-region according to an average gray scale value of the sub-region, when the average gray scale value is greater than a preset gray scale threshold value;

an arithmetic circuit configured to determine a ratio of the total number of original pixel cells in the gray scale threshold value range to the total number of original pixel cells contained in the corresponding sub-region; and a control circuit configured to reset gamma value of the original pixel cell in the corresponding sub-region according to the ratio and a preset gamma value conversion relationship.

Embodiments of the present disclosure further provide a display device, including:

a display panel; and a drive control circuit electrically connected with the display panel, where the drive control circuit is configured to implement a driving method for display panel;

and the driving method for display panel comprises:

dividing the display panel into n sub-regions and calculating an average gray scale value of original pixel cells in each sub-region, where n is an integer greater than 1;

determining a gray scale threshold value range corresponding to the sub-region according to the average gray scale value of the sub-region, when the average gray scale value is greater than a preset gray scale threshold value;

calculating a ratio of the total number of original pixel cells in the gray scale threshold value range to the total number of original pixel cells contained in the corresponding sub-region; and resetting gamma value of original pixel cell in the corresponding sub-region according to the ratio and a preset gamma value conversion relationship.

In the driving method and driving device for display panel, and display device provided by the embodiments of the present disclosure, the display panel is divided into n sub-regions, the average gray scale value of the original pixel cells in each sub-region is determined, the original pixel cell is any one selected from a group consisting of a red pixel cell, a green pixel cell and a blue pixel cell, n is an integer greater than 1; when the average gray scale value is greater than a preset gray scale threshold value range, a gray scale threshold value range corresponding to the sub-region is determined according to the average gray scale value of the sub-region, and a ratio of the total number of original pixel cells in the gray scale threshold value range to the total number of original pixel cells contained in the corresponding sub-region is determined; gamma values of the original pixel cells in the corresponding sub-region are reset according to the ratio and the preset gamma value conversion relationship, the purpose of reducing the color cast of the display panel is achieved, and the problem that the brightness of an existing VA type liquid crystal panel technology at a large viewing angle is rapidly saturated with the increase of driving voltage, such that the image quality of the large viewing angle is worsened, and the experience of the user is greatly influenced is solved.

BRIEF DESCRIPTION OF THE DRAWINGS

In order to explain the embodiments of the present disclosure more clearly, a brief introduction regarding the accompanying drawings that need to be used for describing the embodiments or the prior art is given below; it is obvious that the accompanying drawings described as follows are only some embodiments of the present disclosure, for the ordinarily skilled one in the art, other drawings can also be obtained according to the current drawings on the premise of paying no creative labor.

FIG. 10 illustrates a schematic diagram of dividing the display panel into a plurality of sub-regions provided by an embodiment of the present disclosure;

FIG. 11 illustrates a relational diagram of an average gray scale value of green pixel cells in a sub-region, a corresponding threshold value range and a corresponding positive viewing angle gamma value provided by an embodiment of the present disclosure;

FIG. 12 illustrates a relational diagram of an average gray scale value of red pixel cells in a sub-region, a corresponding threshold value range and a corresponding positive viewing angle gamma value provided by an embodiment of the present disclosure; and FIG. 13 illustrates a relational diagram of an average gray scale value of blue pixel cells in a sub-region, a corresponding threshold value range and a corresponding positive viewing angle gamma value provided by an embodiment of the present disclosure.

DESCRIPTION OF THE EMBODIMENTS

Figure 1:
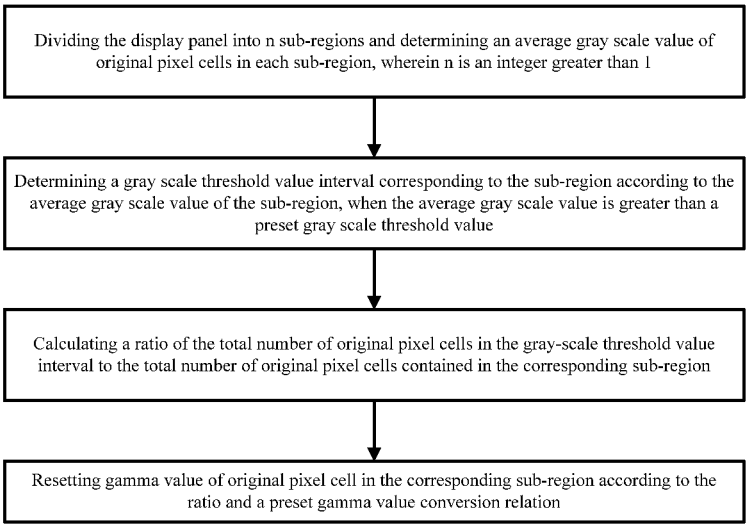
FIG. 1 illustrates a schematic implementation flowchart of a driving method for display panel provided by one embodiment of the present disclosure.

In order to make the technical solutions of the present disclosure be more understandable by the ordinarily skilled one in the art, the technical solutions in the embodiments of the present disclosure will be described clearly with reference to accompanying drawings in the embodiments; it is obvious that, the embodiments described below are only a part of the embodiments of the present disclosure, but not the entire of the embodiments. Based on the embodiments in the present disclosure, some other embodiments, which are obtained by the ordinarily skilled one in the art at the premise of paying no creative labor, should all be included in the protection scope of the present disclosure.

A term "comprise/include" in the description, the claims and the accompanying figures of the present disclosure and their various deformations are intended to cover non-exclusive comprising/including, such as including a process of a list of steps of units, method and system, product and device are not limited to the listed steps or units; however, optionally, the steps or units which are not listed are further included, or optionally, other inherent steps or units for these steps, methods, product and device are further included. Besides, terms including "first", "second" and "third" are intended to distinguish different objects but not used for describing specific sequences.

In the process of driving a VA (Vertical Alignment) type display panel to display, a brightness of the display panel at a large viewing angle may be rapidly saturated with the rising of driving voltage, such that the large viewing angle image quality is seriously worsened with respect to the image quality of the positive viewing angle. In order to solve the problem of viewing angle color cast, a red sub-pixel, a green sub-pixel and a blue sub-pixel of the display panel may be divided into a primary sub-pixel and a subordinate sub-pixel, such that the overall brightness of the display panel at a large viewing angle is closer to the positive viewing angle image quality with the change of voltage, a defect of viewing angle color cast may be overcome by applying different driving voltages to the main sub pixel and the subordinate sub pixel in the space. For the pixel design of dividing of the main sub-pixel and the subordinate sub-pixel, metal wiring usually needs to be redesigned or TFT (Thin Film Transistor) usually needs to be increased to drive sub-pixels, light transmittance opening region be sacrificed, and backlight cost of the panel may be increased.

Each pixel in the display panel is composed of three sub-pixels of red, green, blue. The light source at the back of each sub-pixel may show different brightness levels, particularly, the brightness level is determined by pixel voltage. A gray scale represents a hierarchical level of different brightness from the darkest to the brightest, the more the hierarchical level is, the more exquisite the image display effect is presented. Red, green and blue of different brightness levels are combined to finally form points with different colors. Therefore, a color change of each point on the LCD (Liquid Crystal Display) is caused by gray scale changes of the three sub-pixels which constitute the point, and the pixel voltage is configured to control the gray scale of each sub-pixel point, thereby achieving the purpose of controlling pictures displayed by the display panel. Thus, image quality of images displayed by the display panel may be adjusted by adjusting pixel voltages of all sub-pixels in the display panel.

Gamma value is a correction grayscale coefficient and is a number ranging from 0.1 to 10, brightness of the pictures may be adjusted by adjusting gamma value of a picture; generally, the smaller the gamma value is, the higher the brightness of the picture is; each sub-pixel cell in the display panel has a corresponding gamma value, thus, the image quality of the image may be adjusted by adjusting the gamma value of the image.

FIG. 1 illustrates a schematic implementation flowchart of a driving method for a display panel according to an embodiment of the present disclosure.

As shown in FIG. 1, the driving method for the display panel in this embodiment includes:

dividing the display panel into n sub-regions and calculating an average gray scale value of original pixel cells in each sub-region, where n is an integer larger than 1.

In one or more embodiments, the display panel in a display device is divided into n sub-regions according to the effect that needs to be displayed, the n sub-regions may be formed by dividing in array, where each sub-region has the same area; for example, a display panel with the resolution of 1920*1080 is divided into 135 rows and 240 columns, each sub-region includes 64 pixel cells, and each pixel cell includes a red pixel cell, a green pixel cell and a blue pixel cell. After the display panel is divided into a plurality of sub-regions, an average gray scale value of original pixel cells in each sub-region is determined, the original pixel cell is any one selected from the group consisting of the red pixel cell, the green pixel cell and the blue pixel cell.

Optionally, when the average gray scale value is greater than a preset gray scale threshold value, a gray scale threshold value range corresponding to the sub-region is calculated according to the average gray scale value of the sub-region.

In one or more embodiments, the average gray scale value of the original pixel cells in each sub-region is obtained, and the average gray scale value of the sub-region is judged; when the average gray scale value is greater than the preset gray scale threshold value, a next step is performed, that is, determining a gray scale threshold value range corresponding to the average gray scale value of the sub-region according to the average gray scale value of the sub-region. Particularly, a corresponding first gray scale threshold value and a corresponding second gray scale threshold value are set according to the average gray scale value of each original pixel cell in each sub-region, where the first gray scale threshold value is greater than the second gray scale threshold value, and the first gray scale threshold value and the second gray scale threshold value are set to form a gray scale threshold value range, when the average gray scale value of the sub-region is greater than the second gray scale threshold value and is less than the first gray scale threshold value, the average gray scale threshold value of the sub-region is within the gray scale threshold value range.

In one or more embodiments, the first gray scale threshold value is the sum of the average gray scale value and the first preset gray scale value, the second gray scale threshold value is the substraction of the second preset gray scale threshold value from the average gray scale value, the second gray scale threshold value and the first gray scale threshold value form the gray scale threshold value range; when the average gray scale value of the sub-region is obtained, the gray scale threshold value range where the average gray scale value is within is obtained.

In one or more embodiments, the preset gray scale threshold value is set according to user requirement, and is configured to determine whether the average gray scale value of the original pixel cells in the sub-region is within a high gray scale range or not; when the average gray scale value of the original pixel cells is greater than the preset gray scale threshold value set by the user, the average gray scale value of the original pixel cells in the sub-region is determined as within the high gray scale range, when the average gray scale value of the original pixel cell is less than or equal to the preset gray scale threshold value set by the user, the average gray scale value of the original pixel cells in the sub-region is determined as beyond the high gray scale range.

Optionally, due to the fact that the large view color cast is mainly caused by pixel signals having high gray scale value, thus, when the average gray scale value of the original pixel cells of the sub-region is less than the preset gray scale threshold value, the next step is not performed, that is, the gamma values of the original pixel cells in the sub-region are not reset, so that both calculation time and calculation step are saved. For example, the preset gray scale threshold value in this embodiment may be set to be 180, when the average gray scale value of the original pixel cells in the sub-region is less than 180, the gamma values of the original pixel cells in the sub-region are not adjusted; particularly, each sub-region includes three original pixel cells, that is, each original pixel cell has its own corresponding gamma value, calculation of average gray scale value is performed on the three original pixel cells in each sub-region, the average gray scale value of the three original pixel cells is compared with the preset gray scale threshold value; in one or more embodiments, an original pixel with an average gray scale value greater than the preset gray scale threshold value is selected to determine the gray scale threshold value range, so that the corresponding gamma value is adjusted.

Optionally, a ratio of the total number of original pixel cells in the gray scale threshold value range to the total number of original pixel cells contained in the corresponding sub-region is determined.

In one or more embodiments, the gray scale threshold value range corresponding to the average gray scale value of the sub-region is obtained, and the total number of original pixel cells having the gray scale value within the gray scale threshold value range in the sub-region is determined, and the proportion of the total number of original pixel cells in the gray scale threshold value range to the total number of all original pixel cells in the sub-region is determined.

Optionally, the gamma values of the original pixel cells in the corresponding sub-region are reset according to the ratio and a preset gamma value conversion relationship.

In one or more embodiments, the ratio of the total number of original pixel cells in the gray scale threshold value range to the total number of all original pixel cells in the sub-region is obtained, and the gamma values of the original pixel cells in the corresponding sub-region are reset according to the ratio and the preset gamma value conversion relationship.

In one or more embodiments, the preset gamma value conversion relationship may be set according to user requirement; for example, the preset gamma value conversion relationship may be gamma value corresponding to the ratio of the total number of original pixel cells in the gray scale threshold value range preset by the user to the total number of all original pixel cells in the sub-region.

In one or more embodiments, there is a linear relation between the gamma value preset by the user and the ratio of the total number of original pixel cells in the gray scale threshold value range to the total number of original pixel cells in the sub-region.

In one or more embodiments, the preset gamma value conversion relationship may be gamma value corresponding to the average gray scale value of the original pixel cells in the sub-region, the gamma value may also be a certain linear relation, for example, there is a preset linear relation or nonlinear relation between the average gray scale value of the original pixel cells in the sub-region and the corresponding gamma value.

In one or more embodiments, the ratio of the total number of original pixel cells between the gray scale threshold value range to the total number of original pixel cells in the sub-region is 60%, when the ratio of the total number of original pixel cells between the gray scale threshold value range to the total number of original pixel cells in the sub-region is greater than 60%, the gamma values of the original pixel cells in the sub-region are adjusted; particularly, the adjusting process is to reduce the original gamma values of the original pixel cells in the sub-region, so that the large view angle brightness of the display panel is close to the brightness of the positive viewing angle; generally, gamma value of brightness change corresponding to the optimal signal of the normal viewing angle image quality is 2.2, the reduction of the gamma value of the large viewing angle may increase a linearity of the majority of pixel signals in the sub-region on brightness changes, so that a color cast phenomenon which is prone to occur due to the large viewing angle is reduced.

Figure 2:
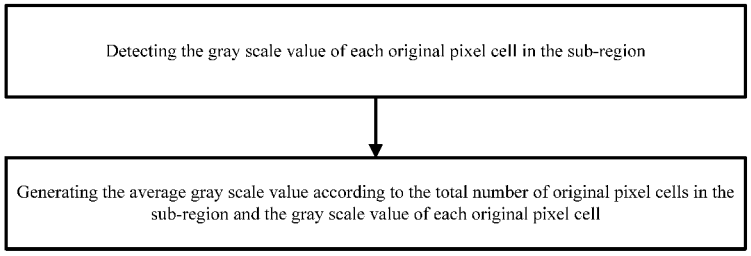
FIG. 2 illustrates a schematic implementation flowchart of a driving method for display panel provided by another embodiment of the present disclosure.

FIG. 2 illustrates a schematic implementation flowchart of a driving method for a display panel provided by another embodiment of the present disclosure.

As shown in FIG. 2, in one or more embodiments, dividing the display panel into N sub-regions and calculating an average gray scale value of original pixel cells in each sub-region includes:

detecting a gray scale value of each original pixel cell in the sub-region.

Optionally, the average gray scale value is generated according to the total number of original pixel cells in the sub-region and the gray scale value of each original pixel cell.

In one or more embodiments, after the display panel is divided into n sub-regions, gray scale value of the original pixel cells in each sub-region is detected, each original pixel cell is divided into three kinds of pixel cells, that is, a red pixel cell, a green pixel cell and a blue pixel cell, that is, the gray scale value of each original pixel cell is detected, and the number of each original pixel cell in each sub-region is counted, and the average gray scale value of each original pixel cell in each sub-region is calculated.

In one or more embodiments, the gray scale threshold value range includes a first gray scale threshold value and a second gray scale threshold value, where, the first gray scale threshold value is greater than the second gray scale threshold value, and the first gray scale threshold value and the second gray scale threshold value are set to form a gray scale threshold value range, when the average gray scale value of the sub-region is greater than the second gray scale threshold value and is less than the first gray scale threshold value, the average gray scale threshold value of the sub-region is within the gray scale threshold value range.

In one or more embodiments, the corresponding first gray scale threshold value and the corresponding second gray scale threshold value is set according to the average gray scale value of each original pixel cell, the first gray scale threshold value is the sum of the average gray scale value and the first preset gray scale value, the second gray scale threshold value is the substraction of the second preset gray scale threshold value from the average gray scale value; particularly, the first gray scale threshold value and the second gray scale threshold value may be set according to user requirement.

In one or more embodiments, the first gray scale threshold value is equal to the second gray scale threshold value.

Figure 3:
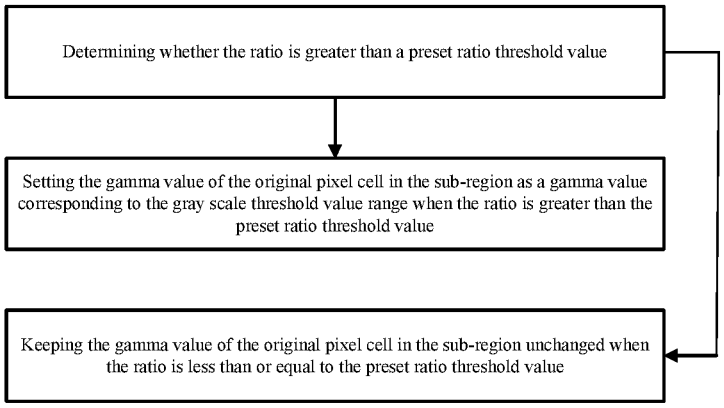
FIG. 3 illustrates a schematic implementation flowchart of a driving method for display panel provided by another embodiment of the present disclosure.

FIG. 3 illustrates a schematic implementation flowchart of a driving method for a display panel according to another embodiment of the present disclosure.

As shown in FIG. 3, in the driving method for the display panel, in one or more embodiments, resetting the gamma values of the original pixel cells in the corresponding sub-region according to the ratio and the preset gamma value conversion relationship includes:

judging whether the ratio is greater than a preset ratio threshold value.

Optionally, the gamma value of the original pixel cell in the sub-region is set as the gamma value corresponding to the gray scale threshold value range when the ratio is greater than the preset ratio threshold value;

Optionally, when the ratio is less than or equal to the preset ratio threshold value, the gamma value of the original pixel cell in the sub-region is kept unchanged.

In one or more embodiments, whether a ratio of the total number of original pixel cells within the gray scale threshold value range to the total number of all original pixel cells in the sub-region is greater than a preset ratio threshold value is determined; optionally, the preset ratio threshold value is 60%, when the ratio of the total number of original pixel cells within the gray scale threshold value range to the total number of all original pixel cells in the sub-region is greater than the preset ratio threshold value, the gamma value of the original pixel cell in the sub-region is set to be gamma value corresponding to the gray scale threshold value range. When the ratio of the total number of original pixel cells within the gray scale threshold value range to the total number of all original pixel cells in the sub-region is less than or equal to the preset ratio threshold value, the gamma values of the original pixel cells in the sub-region are kept unchanged, that is, the original gamma values of the original pixel cells in the sub-region are not reset.

In one or more embodiments, the preset ratio threshold value is set according to user requirement, is configured to determine the proportion of the original pixel cells having the gray scale value within the gray scale threshold value range in the sub-region, and the proportion is configured to determine the degree of large view color cast in the sub-region, when the proportion of the original pixel cells having gray scale value within the gray scale threshold value range is less than the preset ratio threshold value, the next step is not performed, that is, the gamma value of the original pixel cells in the sub-region is not set to be the gamma value corresponding to the gray scale threshold value range.

In one or more embodiments, the preset gamma value conversion relationship in the embodiment includes when the ratio of the total number of original pixel cells within the gray scale threshold value range to the total number of all original pixel cells in the sub-region is greater than the preset ratio threshold value, there is a linear relation between the average gray scale value of the original pixel cells in the sub-region and the preset gamma value; particularly, when the average gray scale value is increased from 180 to 255, the preset gamma value is decreased from 2.2 to 1.85, when the gamma value is set as y, the average gray scale value is set as X, $Y=-(0.35/75)X+0.34$, where X is greater than or equal to 180, and X is less than or equal to 255. In one or more embodiments, when the ratio of the total number of original pixel cells within the gray scale threshold value range to the total number of all original pixel cells in the sub-region is greater than the preset ratio threshold value, the gamma value is corrected downwards from 2.2, and the corresponding equivalent change of large angle gamma value is reduced too, so that the brightness changes of most of original pixel cells in the sub-region are relatively linear.

FIG. 11 illustrates a relational diagram of an average gray scale value of a green pixel cell in a sub-region, the corresponding threshold value range and the corresponding positive viewing angle gamma value provided by one embodiment of the present disclosure.

A driving chip in this embodiment is an 8-bit driving chip, and the gray scale value of the driving chip ranges from 0 to 255, as shown in FIG. 11, Ave_Gn in each block n represents an average gray scale value of a green pixel cell in a sub-region marked as n, the Number of Ave_Gn±X in each block n represents the proportion of the number of green pixel cells having the average gray scale value within the gray scale value threshold value range Ave_Gn±X in the sub-region to the total number of original pixel cells is greater than or equal to Y %; optionally, Y=60%.

Particularly, when different sub-regions to the number of total of pixels in the range is greater than Y %; optionally, Y=60, the gamma signal of the sub-region is changed, so that the positive viewing angle gamma equivalent value of the sub-region is reduced, the signal change of the brightness of the large viewing angle brightness is close to a brightness change gamma value; optionally, gamma<2.4.

In one or more embodiments, the change of the positive viewing angle gamma value ranges from gray scale 180 to gray scale 255, which corresponds to the brightness change gamma value from 2.2 to 1.85, optionally, the brightness change gamma value corresponding to the signal of optimal positive viewing angle image quality is 2.2, when the large viewing angle gamma signal is decreased, the difference of the majority of pixel continuous signals in the sub-region to the brightness change may be reduced.

As shown in FIG. 11, when the driving chip is an 8-bit driving chip, when the average gray scale value of the green pixel cells in the sub-region n ranges from 185 to 195, the proportion of the number of the pixels which have the average gray scale value within the range of (−10, 10) in the sub-region to the total pixel numbers within the range of (−10, 10) is counted; when the proportion is greater than 60%, the gamma adjustment in this range is corrected downwards from 2.2 to 2.15, the gamma signals are corrected downwards, and the corresponding large viewing angle gamma equivalent changes is reduced too, so that brightness changes of most of green sub-pixels in the range are relatively linear, by such analogy, the gray scale average value range in the sub-region n corresponds to different gamma value changes.

FIG. 12 illustrates a relational diagram of an average gray scale value of a red pixel cell in a sub-region, the corresponding threshold value range and the corresponding positive viewing angle gamma value provided by one embodiment of the present disclosure. A driving chip in this embodiment is an 8-bit driving chip, and the gray scale value of the driving chip ranges from 0 to 255, as shown in FIG. 12, Ave_Rn in each block n represents an average gray scale value of a red pixel cell in a sub-region marked as n, the Number of Ave_Rn±x in each block n represents the proportion of the number of red pixel cells which have the average gray scale value within the gray scale value threshold value range Ave_Rn±/X in the sub-region to the total number of original pixel cells is greater than or equal to Y %; optionally, y=60%.

When the proportion of the number of red pixel cells having the average gray scale value within the gray scale value threshold value range Ave_Rn±/X in the sub-region to the total number of original pixel cells is greater than Y %, the gamma value of the red pixel cells in the sub-region is adjusted according to the average gray scale value of the red pixel cell in the sub-region as shown in FIG. 12, the corresponding threshold value range and the corresponding positive viewing angle gamma value, so that the gamma value is reduced, and the color cast phenomenon which is prone to occur due to the large viewing angle is reduced; optionally, the variation Z of the positive viewing angle gamma value is 0.5.

FIG. 13 illustrates a relational diagram of an average gray scale value of a blue pixel cell in a sub-region, the corresponding threshold value range and the corresponding positive viewing angle gamma value provided by one embodiment of the present disclosure. A driving chip in this embodiment is an 8-bit driving chip, and the gray scale value of the driving chip ranges from 0 to 255, as shown in FIG. 13, Ave_Bn in each block n represents an average gray scale value of a blue pixel cell in a sub-region marked as n, and the Number of Ave_Bn±x in each block n represents the proportion of the number of blue pixel cells which have the average gray scale value within the gray scale value threshold value range Ave_Bn±/X in the sub-region to the total number of original pixel cells is greater than or equal to Y %; optionally, y=60%. When the proportion of the number of blue pixel cells which have the average gray scale value within the gray scale value threshold value range Ave_Bn±/X in the sub-region to the total number of original pixel cells is greater than Y %, the gamma value of the blue pixel cells in the sub-region is adjusted according to the average gray scale value of the blue pixel cell in the sub-region as shown in FIG. 13, the corresponding threshold value range and the corresponding positive viewing angle gamma value, so that the gamma value is reduced, and the color cast phenomenon which is prone to occur due to the large viewing angle is reduced; optionally, the variation Z of the positive viewing angle gamma value is 0.5.

Figure 4:
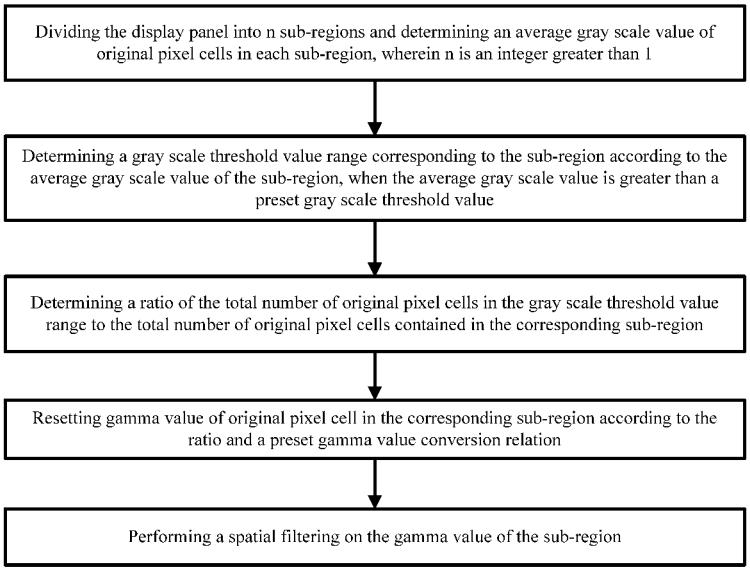
FIG. 4 illustrates a schematic implementation flowchart of a driving method for display panel provided by another embodiment of the present disclosure.

FIG. 4 illustrates an implementation flowchart of a driving method for a display panel according to another embodiment of the present disclosure.

As shown in FIG. 4, the driving method in this embodiment further includes:

performing spatial filtering on the gamma value of the sub-region.

In one or more embodiments, difference conditions of gray scale values in n sub-regions divided by the display panel may be different, the compensation signals configured to reset the gamma values in each sub-region are different, therefore, the trends of display images which change with the gray scale values are also different, which may cause the brightness and the gray scale value between the various sub-regions be different, such that a boundary phenomenon of non-smooth transition between the sub-region and the adjacent sub-region may be generated.

In one or more embodiments, spatial filtering is performed on the gamma values of the sub-region, particularly, when the ratio of the total number of original pixel cells within the gray scale threshold value range to the total number of all original pixel cells in the sub-region is greater than a preset ratio threshold value, the gamma value of the original pixel cell in the sub-region is reset, and spatial filtering is performed on the sub-region; spatial filtering can be performed by using an image enhancement method of filtering processing to process images, that is, the image space geometric variable domain is directly modified, image data is restrained, and noise filtering is reduced.

In one or more embodiments, said performing spatial filtering on the gamma value of the sub-region includes:

performing low-pass filtering processing on the gamma value of the sub-region.

Particularly, the low-pass filtering is performed on the gamma values of the sub-region, such that the images in the display panel are smoother, and the images are sharpened through high-pass filtering.

In one or more embodiments, performing low-pass filtering processing on the gamma values of the sub-region includes:

performing low-pass filtering processing on the sub-region according to the gamma value of the sub-region and gamma value of a sub-region adjacent to the sub-region.

FIG. 10 illustrates a schematic diagram of dividing a display panel into a plurality of sub-regions according to an embodiment of the present disclosure, as shown in FIG. 10, low-pass filtering is performed on a coordinate (x, y), where x and y are integers greater than 1, F(x, y) represents the gamma value of the sub-region of the coordinate of (x, y), and the coordinate is the gamma value of the sub-region of the coordinate of (x, y), gamma values of eight sub-regions adjacent to the sub-region of the coordinate (x, y) are F (x−1, y−1), F (x−1, y), F (x−1, y+1), F(x, y−1), F (x, y+1), F(x+1, y−1), F(x+1, y) and F (x+1, y+1) respectively, where, F(x−1, y−1) is the gamma value of a sub-region of a coordinate (x−1, y−1), and F (x−1, y+1) is the gamma value of a sub-region of a coordinate (x−1, y), F(x−1, y+1) is the gamma value of a sub-region of a coordinate (x−1, y+1), F(x, y−1) is the gamma value of sub-region of a coordinate (x, y−1), F(x, y+1) is the gamma value of a sub-region of a coordinate (x, y+1), F (x+1, y−1) is the gamma value of a sub-region of a coordinate (x+1, y−1), F(x+1, y) is the gamma value of a sub-region of a coordinate (x+1, y), F(x+1, y+1) is the gamma value of a sub-region of a coordinate (x+1, y+1). Optionally, weights of F(x−1, y−1), F(x−1, y), F(x−1, y+1), F(x, y−1), F(x, y), F(x, y+1), F(x+1, y−1), F(x+1, y) and F(x+1, y+1) are w1, w2, w3, w4, w5, w6, w7, w8 and w9 respectively, then, the gamma value of the sub-region of the coordinate (x, y) after spatial filtering is formulated as: g (x, y)=F(x−1, y−1)*w1+F(x−1, y)*w2+F(x−1, y+1)*w3+F(x, y−1)*w4+F(x, y−1)*w4+F(x, y)*w5+F(x, y+1)*w6+F(x+1, y−1)*w7+F(x+1, y)*w8+F(x+1, y+1)*w9.

Optionally, the weights of F(x−1, y−1), F(x−1, y), F(x−1, y+1), F(x, y−1), F(x, y), F(x, y+1), F(x, y+1), F(x+1, y−1), F(x+1, y) and F(x+1, y+1) may be set according to a uniformity of penetration rate of a real panel, where the sum of the weights of the gamma values F(x−1,y−1), F(x−1, y), F(x−1, y+1), F(x−1, y+1), F(x, y−1), F(x, y), F(x, y+1), F(x+1, y−1), F(x+1, y) and F(x+1, y+1) of the nine sub-regions is equal to 1, that is, w1+w2+w3+w4+w5+w6+w7+w8+w9=1, for example, w1, w2, w3, w4, w5, w6, w7, w8 and w9 may be the same value, for example, w1, w2, w3, w4, w5, w6, w7 and w8 may be ⅛; w1, w2, w3, w4, w5, w6, w7, w8 and w9 may also be different values, the weights of the gamma values of the various sub-regions may be adjusted by the user according to the requirement, so that the change of adjacent sub-regions is not obvious.

Figure 5:
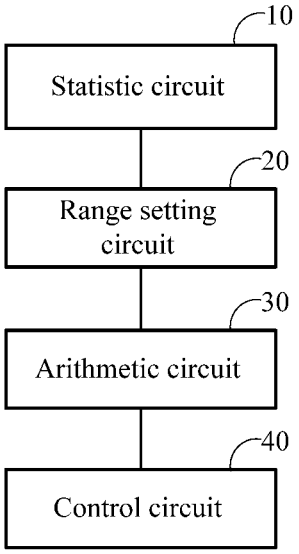
FIG. 5 illustrates a schematic structural diagram of a driving device for display panel provided by one embodiment two of the present disclosure.

FIG. 5 illustrates a schematic structural diagram of a driving device for a display panel provided by an embodiment of the present disclosure.

As shown in FIG. 5, the driving device includes:

a statistic circuit 10 configured to divide the display panel into n sub-regions and determine an average gray scale value of original pixel cells in each sub-region, each original pixel cell is any one selected from a group consisting of a red pixel cell, a green pixel cell and a blue pixel cell, where n is an integer larger than 1.

an range setting circuit 20 configured to determine a gray scale threshold value range corresponding to the sub-region according to the average gray scale value of the sub-region, when the average gray scale value is greater than a preset gray scale threshold value;

an arithmetic circuit 30 configured to determine a ratio of the total number of original pixel cells in the gray scale threshold value range to the total number of original pixel cells contained in the corresponding sub-region; and a control circuit 40 configured to reset gamma value of the original pixel cell in the corresponding sub-region according to the ratio and preset gamma value conversion relationship.

In one or more embodiments, the display panel in a display device is divided by the statistic circuit 10 into n sub-regions according to the effect that needs to be displayed, the n sub-regions may be formed by dividing in array, where each sub-region has the same area; for example, a display panel with the resolution of 1920*1080 is divided into 135 rows and 240 columns, each sub-region includes 64 pixel cells, and each pixel cell includes a red pixel cell, a green pixel cell and a blue pixel cell. After the display panel is divided into a plurality of sub-regions, an average gray scale value of original pixel cells in each sub-region is determined, and the original pixel cell is any one selected from the group consisting of the red pixel cell, the green pixel cell and the blue pixel cell. The range setting circuit 20 obtains an average gray scale value of original pixel cells in each sub-region and determines the average gray scale value of each sub-region, when the average gray scale value is greater than the preset gray scale threshold value, the gray scale threshold value range corresponding to the average gray scale value is determined according to the average gray scale value of the sub-region; due to the fact that the large view color cast is mainly caused by pixel signals having high gray scale value, thus, when the average gray scale value of the original pixel cells of the sub-region is less than the preset gray scale threshold value, the gamma values of the original pixel cells in the sub-region are not reset, so that both calculation time and calculation step are saved. For example, the preset gray scale threshold value in this embodiment may be set to be 180, when the average gray scale value of the original pixel cells in the sub-region is less than 180, the gamma values of the original pixel cells in the sub-region are not adjusted.

Particularly, each sub-region includes three original pixel cells, that is, each original pixel cell has its own corresponding gamma value, calculation of average gray scale value is performed on the three original pixel cells in each sub-region, the average gray scale value of the three original pixel cells is compared with the preset gray scale threshold value.

In one or more embodiments, an original pixel with an average gray scale value greater than the preset gray scale threshold value is selected to determine the gray scale threshold value range, such that the corresponding gamma value is adjusted. The arithmetic circuit 30 is configured to obtain the gray scale threshold value range corresponding to the average gray scale value of the sub-region, and to determine the total number of original pixel cells which have the gray scale value within the gray scale threshold value range in the sub-region, and to determine the proportion of the total number of original pixel cells in the gray scale threshold value range to the total number of all original pixel cells in the sub-region. The control circuit 40 is configured to obtain the ratio of the total number of original pixel cells in the gray scale threshold value range to the total number of all original pixel cells in the sub-region, and reset the gamma values of the original pixel cells in the corresponding sub-region according to the ratio and the preset gamma value conversion relationship.

In one or more embodiments, the preset gamma value conversion relationship may be set according to user requirement; for example, the preset gamma value conversion relationship may be gamma value corresponding to the ratio of the total number of original pixel cells in the gray scale threshold value range preset by the user to the total number of all original pixel cells in the sub-region, or alternatively be gamma value corresponding to the average gray scale value of the original pixel cells in the sub-region, the gamma value may also be a certain linear relation, for example, there is a preset linear relation or nonlinear relation between the average gray scale value of the original pixel cells in the sub-region and the corresponding gamma value.

In one or more embodiments, the ratio of the total number of original pixel cells between the gray scale threshold value range to the total number of original pixel cells in the sub-region is 60%, when the ratio of the total number of original pixel cells between the gray scale threshold value range to the total number of original pixel cells in the sub-region is greater than 60%, the gamma values of the original pixel cells in the sub-region are adjusted; particularly, the adjusting process is to reduce the original gamma values of the original pixel cells in the sub-region, so that the large view angle brightness of the display panel is close to the brightness of the positive viewing angle; generally, gamma value of brightness change corresponding to the optimal signal of the normal viewing angle image quality is 2.2, the reduction of the gamma value of the large viewing angle may increase a linearity of the majority of pixel signals in the sub-region on brightness changes, so that a color cast phenomenon which is prone to occur due to the large viewing angle is reduced.

FIG. 11 illustrates a relational diagram of an average gray scale value of a green pixel cell in a sub-region, the corresponding threshold value range and the corresponding positive viewing angle gamma value provided by one embodiment of the present disclosure.

A driving chip in this embodiment is an 8-bit driving chip, and the gray scale value of the driving chip ranges from 0 to 255, as shown in FIG. 11, Ave_Gn in each block n represents an average gray scale value of a green pixel cell in a sub-region marked as n, the Number of Ave_Gn±X in each block n represents the proportion of the number of green pixel cells having the average gray scale value within the gray scale value threshold value range Ave_Gn±X in the sub-region to the total number of original pixel cells is greater than or equal to Y %; optionally, Y=60%.

Particularly, when different sub-regions to the number of total of pixels in the range is greater than Y %; optionally, Y=60, the gamma signal of the sub-region is changed, so that the positive viewing angle gamma equivalent value of the sub-region is reduced, the signal change of the brightness of the large viewing angle brightness is close to a brightness change gamma value; optionally, gamma<2.4.

In one or more embodiments, the change of the positive viewing angle gamma value ranges from gray scale 180 to gray scale 255, which corresponds to the brightness change gamma value from 2.2 to 1.85; optionally, the brightness change gamma value corresponding to the signal of optimal positive viewing angle image quality is 2.2, when the large viewing angle gamma signal is decreased, the difference of the majority of pixel continuous signals in the sub-region to the brightness change may be reduced.

As shown in FIG. 11, when the driving chip is an 8-bit driving chip, when the average gray scale value of the green pixel cells in the sub-region n ranges from 185 to 195, the proportion of the number of the pixels which have the average gray scale value within the range of (−10, 10) in the sub-region to the total pixel numbers within the range of (−10, 10) is counted; when the proportion is greater than 60%, the gamma adjustment in this range is corrected downwards from 2.2 to 2.15, the gamma signals are corrected downwards, and the corresponding large viewing angle gamma equivalent changes is reduced, too, so that brightness changes of most of green sub-pixels in the range are relatively linear, by such analogy, the gray scale average value range in the sub-region n corresponds to different gamma value changes.

FIG. 12 illustrates a relational diagram of an average gray scale value of a red pixel cell in a sub-region, the corresponding threshold value range and the corresponding positive viewing angle gamma value provided by one embodiment of the present disclosure. A driving chip in this embodiment is an 8-bit driving chip, and the gray scale value of the driving chip ranges from 0 to 255, as shown in FIG. 12, Ave_Rn in each block n represents an average gray scale value of a red pixel cell in a sub-region marked as n, the Number of Ave_Rn±x in each block n represents the proportion of the number of red pixel cells which have the average gray scale value within the gray scale value threshold value range Ave_Rn±/X in the sub-region to the total number of original pixel cells is greater than or equal to Y %; optionally, y=60%.

When the proportion of the number of red pixel cells having the average gray scale value within the gray scale value threshold value range Ave_Rn±/X in the sub-region to the total number of original pixel cells is greater than Y %, the gamma value of the red pixel cells in the sub-region is adjusted according to the average gray scale value of the red pixel cell in the sub-region as shown in FIG. 12, the corresponding threshold value range and the corresponding positive viewing angle gamma value, so that the gamma value is reduced, and the color cast phenomenon which is prone to occur due to the large viewing angle is reduced; optionally, the variation Z of the positive viewing angle gamma value is 0.5.

FIG. 13 illustrates a relational diagram of an average gray scale value of a blue pixel cell in a sub-region, the corresponding threshold value range and the corresponding positive viewing angle gamma value provided by one embodiment of the present disclosure. A driving chip in this embodiment is an 8-bit driving chip, and the gray scale value of the driving chip ranges from 0 to 255, as shown in FIG. 13, Ave_Bn in each block n represents an average gray scale value of a blue pixel cell in a sub-region marked as n, and the Number of Ave_Bn±x in each block n represents the proportion of the number of blue pixel cells which have the average gray scale value within the gray scale value threshold value range Ave_Bn±/X in the sub-region to the total number of original pixel cells is greater than or equal to Y %; optionally, y=60%. When the proportion of the number of blue pixel cells which have the average gray scale value within the gray scale value threshold value range Ave_Bn±/X in the sub-region to the total number of original pixel cells is greater than Y %, the gamma value of the blue pixel cells in the sub-region is adjusted according to the average gray scale value of the blue pixel cell in the sub-region as shown in FIG. 13, the corresponding threshold value range and the corresponding positive viewing angle gamma value, so that the gamma value is reduced, and the color cast phenomenon which is prone to occur due to the large viewing angle is reduced; optionally, the variation Z of the positive viewing angle gamma value is 0.5.

Figure 6:
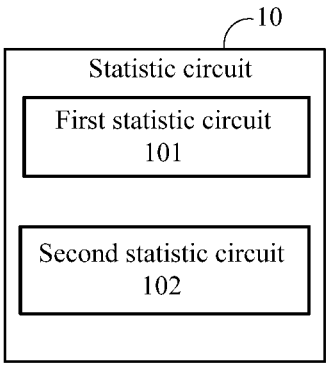
FIG. 6 illustrates a schematic structural diagram of a driving device for display panel provided by another embodiment of the present disclosure.

FIG. 6 illustrates a schematic structural diagram of a driving device for a display panel provided by another embodiment of the present disclosure.

As shown in FIG. 6, the statistic circuit 10 includes:

a first statistic circuit 101 configured to detect a gray scale value of each original pixel cell in the sub-region;

a second statistic circuit 102 configured to generate an average gray scale value according to the total number of original pixel cells in the sub-region and the gray scale value of each original pixel cell.

In one or more embodiments, after the first statistic circuit 101 divides the display panel into n sub-regions, the gray scale values of the original pixel cells in each sub-region are detected, the original pixel cell is divided into three types of pixel cells including a red pixel cell, a green pixel cell and a blue pixel cell, that is, the gray scale value of each original pixel cell is detected, and the number of each original pixel cell in each sub-region is counted; the second statistic circuit 102 is configured to determine the average gray scale value of each original pixel cell in each sub-region.

Figure 7:
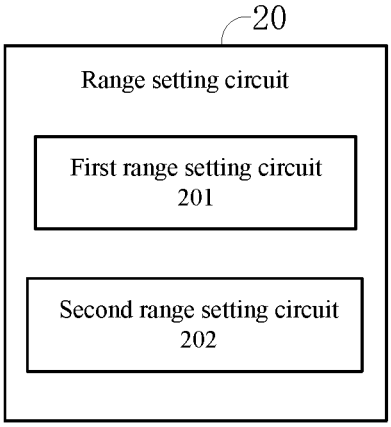
FIG. 7 illustrates a schematic structural diagram of a driving device for display panel provided by another embodiment of the present disclosure.

FIG. 7 illustrates a schematic structural diagram of a driving device for a display panel according to another embodiment of the present disclosure.

As shown in FIG. 7, the range setting circuit 20 includes:

a first range setting circuit 201 configured to set a first gray scale threshold value of a gray scale threshold value range, where the first gray scale threshold value is the sum of an average gray scale value and a first preset gray scale value;

a second range setting circuit 202 configured to set a second gray scale threshold value of a gray scale threshold value range, where the second gray scale threshold value is the substraction of the second preset gray scale value from the average gray scale value.

A corresponding first gray scale threshold value and a corresponding second gray scale threshold value are set by the a first range setting circuit 201 and the second range setting circuit 202 respectively according to the average gray scale value of each original pixel cell, where the first gray scale threshold value is greater than the second gray scale threshold value, and the first gray scale threshold value and the second gray scale threshold value are set to form a gray scale threshold value range, and when the average gray scale value of the sub-region is greater than the second gray scale threshold value and is less than the first gray scale threshold value, the average gray scale threshold value of the sub-region is within the gray scale threshold value range.

In one or more embodiments, the first gray scale threshold value is the sum of the average gray scale value and the first preset gray scale value, and the second gray scale threshold value is the substraction of the second preset gray scale value from the average gray scale value; particularly, the first preset gray scale value and the second preset gray scale value may be set according to user requirement.

In one or more embodiments, the first preset gray scale value is equal to the second preset gray scale value.

Figure 8:
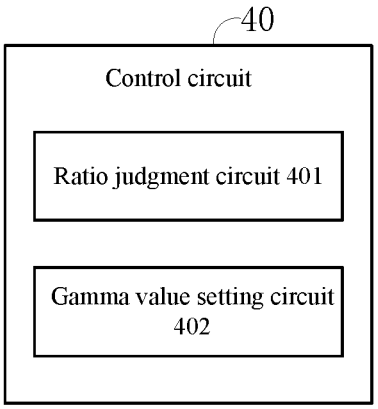
FIG. 8 illustrates a schematic structural diagram of a driving device for display panel provided by another embodiment of the present disclosure.

FIG. 8 illustrates a schematic structural diagram of a driving device for a display panel according to another embodiment of the present disclosure.

As shown in FIG. 8, the control circuit 40 includes:

a ratio judgment circuit 401 configured to judge whether the ratio is greater than a preset ratio threshold value or not;

gamma value setting circuit 402 configured to be set the gamma values of the original pixel cells in the sub-region as the gamma value corresponding to the gray scale threshold value range, and to keep the gamma values of the original pixel cells in the sub-region unchanged when the ratio is less than or equal to the preset ratio threshold value.

In one or more embodiments, the ratio judgment circuit 401 judges whether a ratio of the total number of original pixel cells within the gray scale threshold value range to the total number of all original pixel cells in the sub-region is greater than a preset ratio threshold value; optionally, the preset ratio threshold value is 60%; when the ratio of the total number of original pixel cells within the gray scale threshold value range to the total number of all original pixel cells in the sub-region is greater than the preset ratio threshold value, the gamma value setting circuit 402 sets the gamma value of the original pixel cell in the sub-region to be gamma value corresponding to the gray scale threshold value range. When the ratio of the total number of original pixel cells within the gray scale threshold value range to the total number of all original pixel cells in the sub-region is less than or equal to the preset ratio threshold value, the gamma values of the original pixel cells in the sub-region are kept unchanged, that is, the original gamma values of the original pixel cells in the sub-region are not reset.

In one or more embodiments, the preset gamma value conversion relationship in the embodiment includes when the ratio of the total number of original pixel cells within the gray scale threshold value range to the total number of all original pixel cells in the sub-region is greater than the preset ratio threshold value, there is a linear relation between the average gray scale value of the original pixel cells in the sub-region and the preset gamma value; particularly, when the average gray scale value is increased from 180 to 255, the preset gamma value is decreased from 2.2 to 1.85, when the gamma value is set as y, the average gray scale value is set as X, $Y=-(0.35/75)x+0.34$, where X is greater than or equal to 180, and X is less than or equal to 255. In one or more embodiments, when the ratio of the total number of original pixel cells within the gray scale threshold value range to the total number of all original pixel cells in the sub-region is greater than the preset ratio threshold value, the gamma value is corrected downwards from 2.2, and the corresponding equivalent change of large angle gamma value is reduced too, so that the brightness changes of most of original pixel cells in the sub-region are relatively linear.

Figure 9:
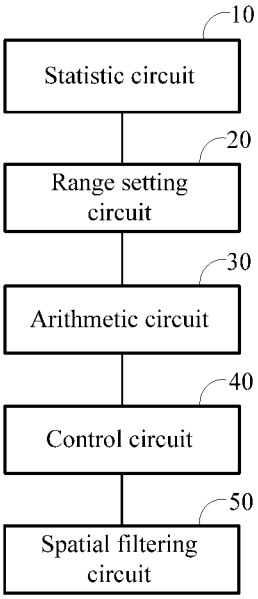
FIG. 9 illustrates a schematic structural diagram of a driving device for display panel provided by another embodiment of the present disclosure.

FIG. 9 illustrates a driving device for a display panel provided by another embodiment of the present disclosure.

As shown in FIG. 9, the driving device further includes a spatial filtering circuit 50 configured to perform a spatial filtering on gamma value of the sub-region.

In one or more embodiments, difference conditions of gray scale values in n sub-regions divided by the display panel may be different, the compensation signals configured to reset the gamma values in each sub-region are different, therefore, the trends of display images which change with the gray scale values are also different, which may cause the brightness and the gray scale value between the various sub-regions be different, such that a boundary phenomenon of non-smooth transition between the sub-region and the adjacent sub-region may be generated.

In one or more embodiments, the spatial filtering circuit 50 is configured to perform spatial filtering on the gamma values of the sub-region, particularly, the corrected original pixel cell in the sub-region is that the ratio of the total number of original pixel cells within the gray scale threshold value range to the total number of all original pixel cells in the sub-region is greater than a preset ratio threshold value, when the gamma value of the original pixel cell in the sub-region is reset, spatial filtering is performed on the sub-region; spatial filtering can be performed by using an image enhancement method of filtering processing to process images, that is, the image space geometric variable domain is directly modified, image data is restrained, and noise filtering is reduced.

In one or more embodiments, said performing spatial filtering on the gamma value of the sub-region includes:

performing low-pass filtering processing on the sub-region according to the gamma value of the sub-region and gamma value of a sub-region adjacent to the sub-region.

FIG. 10 illustrates a schematic diagram of dividing a display panel into a plurality of sub-regions in this embodiment. As shown in FIG. 10, the spatial filtering circuit 50 performs low-pass filtering on a coordinate (x, y), where x and y are integers greater than 1, F(x, y) represents the gamma value of the sub-region of the coordinate of (x, y), and the coordinate is the gamma value of the sub-region of the coordinate of (x, y), gamma values of eight sub-regions adjacent to the sub-region of the coordinate (x, y) are respectively F (x−1, y−1), F (x−1, y), F (x−1, y+1), F(x, y−1), F (x, y+1), F(x+1, y−1), F(x+1, y) and F (x+1, y+1), where F(x−1, y−1) is the gamma value of a sub-region of a coordinate (x−1, y−1), and F (x−1, y+1) is the gamma value of a sub-region of a coordinate (x−1, y), F(x−1, y+1) is the gamma value of a sub-region of a coordinate (x−1, y+1), F(x, y−1) is the gamma value of sub-region of a coordinate (x, y−1), F(x, y+1) is the gamma value of a sub-region of a coordinate (x, y+1), F (x+1, y−1) is the gamma value of a sub-region of a coordinate (x+1, y−1), F(x+1, y) is the gamma value of a sub-region of a coordinate (x+1, y), F(x+1, y+1) is the gamma value of a sub-region of a coordinate (x+1, y+1).

Optionally, weights of F(x−1, y−1), F(x−1, y), F(x−1, y+1), F(x, y−1), F(x, y), F(x, y+1), F(x+1, y−1), F(x+1, y) and F(x+1, y+1) are respectively w1, w2, w3, w4, w5, w6, w7, w8 and w9, then, the gamma value of the sub-region of the coordinate (x, y) after spatial filtering is formulated as: g (x, y)=F(x−1, y−1)*w1+F(x−1, y)*w2+F(x−1, y+1)*w3+F(x, y−1)*w4+F(x, y−1)*w4+F(x, y)*w5+F(x, y+1)*w6+F(x+1, y−1)*w7+F(x+1, y)*w8+F(x+1, y+1)*w9.

Optionally, the weights of F(x−1, y−1), F(x−1, y), F(x−1, y+1), F(x, y−1), F(x, y), F(x, y+1), F(x, y+1), F(x+1, y−1), F(x+1, y) and F(x+1, y+1) may be set according to a uniformity of penetration rate of a real panel, where the sum of the weights of the gamma values F(x−1, y−1), F(x−1, y), F(x−1, y+1), F(x−1, y+1), F(x, y−1), F(x, y), F(x, y+1), F(x+1, y−1), F(x+1, y) and F(x+1, y+1) of the nine sub-regions is equal to 1, that is, w1+w2+w3+w4+w5+w6+w7+w8+w9=1, for example, w1, w2, w3, w4, w5, w6, w7, w8 and w9 may be the same value, for example, w1, w2, w3, w4, w5, w6, w7 and w8 may be ⅛; w1, w2, w3, w4, w5, w6, w7, w8 and w9 may also be different values, the weights of the gamma values of the various sub-regions may be adjusted by the user according to the requirement, such that the change of adjacent sub-regions is not obvious.

In one or more embodiments, a display device proposed in this embodiment includes:

a display panel; and a drive control circuit electrically connected with the display panel, where the drive control circuit is configured to implement a driving method for display panel;

and the method of driving display panel includes:

dividing the display panel into n sub-regions and calculating an average gray scale value of original pixel cells in each sub-region, where n is an integer greater than 1;

determining a gray scale threshold value range corresponding to the sub-region according to the average gray scale value of the sub-region, when the average gray scale value is greater than a preset gray scale threshold value;

calculating a ratio of the total number of original pixel cells in the gray scale threshold value range to the total number of original pixel cells contained in the corresponding sub-region; and resetting gamma value of original pixel cell in the corresponding sub-region according to the ratio and a preset gamma value conversion relationship.

In one or more embodiments, the ratio of the total number of original pixel cells in the gray scale threshold value range to the total number of original pixel cells contained in the corresponding sub-region is obtained, and the gamma values corresponding to the original pixel cells in the corresponding sub-region are reset.

In one or more embodiments, the display device may be any type of display device, such as LCD (Liquid Crystal Display), OLED (Organic Light Emitting Diode), QLED (Quantum Dot Light Emitting Diode), or a curved surface display device or the like.

In one or more embodiments, the display panel includes an array of the original pixel cells consisted of rows of pixels and columns of pixels.

In one or more embodiments, the drive control circuit may be implemented by an universal integrated circuit such as CPU (Central Processing Unit) or ASIC (Application Specific Integrated Circuit).

The ordinarily skilled one in the art may be aware of that, a whole or part of flow process of implementing the method in the aforesaid embodiments of the present disclosure may be accomplished by using computer program to instruct relevant hardware. When the computer program is executed, the steps in the various method embodiments described above may be included. Where, the storage medium may be ROM (Read-Only Memory), RAM (Random Access Memory), and so on.

The foregoing is only optional embodiments of the present disclosure and is not intended to limit the present disclosure. Any modification, equivalent replacement, improvement, and so on, which are made within the spirit and the principle of the present disclosure, should all be included in the protection scope of the present disclosure.

What is claimed is:

1. A driving method for display panel, comprising:

dividing the display panel into n sub-regions and calculating an average gray scale value of original pixel cells in each sub-region, wherein n is an integer greater than 1; wherein the calculating an average gray scale value of original pixel cells in each sub-region comprises:

detecting the gray scale value of each original pixel cell in the sub-region; and generating the average gray scale value according to the total number of original pixel cells in the sub-region and the gray scale value of each original pixel cell;

determining a gray scale threshold value range corresponding to the sub-region according to the average gray scale value of the sub-region, when the average gray scale value is greater than a preset gray scale threshold value;

calculating a ratio of the total number of original pixel cells in the gray scale threshold value range to the total number of original pixel cells contained in the corresponding sub-region; and resetting gamma value of original pixel cell in the corresponding sub-region according to the ratio and a preset gamma value conversion relationship.

2. The driving method according to claim 1, wherein the calculating a ratio of the total number of original pixel cells in the gray scale threshold value range to the total number of original pixel cells contained in the corresponding sub-region comprises:

obtaining the gray scale threshold value range corresponding to the average gray scale value of the sub-region and calculating the total number of original pixel cells in the sub-region which have the gray scale value within the gray scale threshold value range;

obtaining the total number of original pixel cells in the sub-region; and calculating a ratio of the total number of original pixel cells in the sub-region which have the gray scale value within the gray scale threshold value range to the total number of original pixel cells in the sub-region.

3. The driving method according to claim 1, wherein the gray scale threshold value range comprises a first gray scale threshold value and a second gray scale threshold value;

wherein the first gray scale threshold value is the sum of the average gray scale value and a first preset gray scale value; and the second gray scale threshold value is the substraction of a second preset gray scale value from the average gray scale value.

4. The driving method according to claim 3, wherein the first preset gray scale threshold value is equal to the second preset gray scale threshold value.

5. The driving method according to claim 1, wherein the resetting gamma value of original pixel cell in the corresponding sub-region according to the ratio and a preset gamma value conversion relationship comprises:

judging whether the ratio is greater than a preset ratio threshold value or not;

setting the gamma value of the original pixel cell in the sub-region as gamma value corresponding to the gray scale threshold value range when the ratio is greater than the preset ratio threshold value;

keeping the gamma value of the original pixel cell in the sub-region unchanged when the ratio is less than or equal to the preset ratio threshold value.

6. The driving method according to claim 5, wherein the preset ratio threshold value is 60%.

7. The driving method according to claim 1, wherein the preset gamma value conversion relationship comprises:

gamma value corresponding to the ratio of the total number of original pixel cells in the gray scale threshold value range preset by a user to the total number of original pixel cells in the sub-region.

8. The driving method according to claim 7, wherein there is a linear relation between the gamma value preset by the user and the ratio of the total number of original pixel cells in the gray scale threshold value range to the total number of original pixel cells in the sub-region.

9. The driving method according to claim 1, further comprising;

performing a spatial filtering on the gamma value of the sub-region.

10. The driving method according to claim 9, wherein performing spatial filtering on the gamma value of the sub-region comprises:

performing a low-pass filtering process on the gamma value of the sub-region.

11. The driving method according to claim 10, wherein the performing a low-pass filtering process on the gamma value of the sub-region comprises:

performing the low-pass filtering processing on the sub-region according to the gamma value of the sub-region and gamma value of a sub-region adjacent to the sub-region.

12. A driving device for display panel, comprising:

a statistic circuit configured to divide the display panel into n sub-regions and to determine an average gray scale value of original pixel cells in each sub-region, wherein the original pixel cell is any one selected from a group consisting of a red pixel cell, a green pixel cell and a blue pixel cell, and wherein n is an integer greater than 1; wherein the statistic circuit comprises: a first statistic circuit configured to detect the gray scale value of each original pixel cell in the sub-region: and a second statistic circuit configured to generate the average gray scale value according to the total number of original pixel cells in the sub-region and the gray scale value of each original pixel cell;

an range setting circuit configured to determine a gray scale threshold value range corresponding to the sub-region according to an average gray scale value of the sub-region, when the average gray scale value is greater than a preset gray scale threshold value;

an arithmetic circuit configured to determine a ratio of the total number of original pixel cells in the gray scale threshold value range to the total number of original pixel cells contained in the corresponding sub-region; and a control circuit configured to reset gamma value of the original pixel cell in the corresponding sub-region according to the ratio and a preset gamma value conversion relationship.

13. The driving device according to claim 12, wherein range setting circuit comprises:

a first range setting circuit configured to set a first gray scale threshold value, wherein the first gray scale threshold value is the sum of the average gray scale value and a first preset gray scale value; and a second range setting circuit configured to set a second gray scale threshold value, wherein the second gray scale threshold value is the substraction of a second preset gray scale value from the average gray scale value.

14. The driving device according to claim 13, wherein the first preset gray scale threshold value is equal to the second preset gray scale threshold value.

15. The driving device according to claim 12, wherein the control circuit comprises:

a ratio arithmetic circuit configured to determine whether the ratio is greater than a preset ratio threshold value or not;

a gamma value setting circuit configured to set the gamma value of the original pixel cell in the sub-region as gamma value corresponding to the gray scale threshold value range when the ratio is greater than the preset ratio threshold value, and to keep the gamma value of the original pixel cell in the sub-region unchanged when the ratio is less than or equal to the preset ratio threshold value.

16. The driving device according to claim 12, further comprising:

a spatial filtering circuit configured to perform a spatial filtering on the gamma value in the sub-region.

17. The driving device according to claim 12, wherein the spatial filtering circuit is further configured to perform a low-pass filtering processing on the sub-region according to the gamma value of the sub-region and gamma value of a sub-region adjacent to the sub-region.

18. A display device, comprising:

a display panel; and a drive control circuit electrically connected with the display panel, wherein the drive control circuit is configured to implement a driving method for display panel;

wherein the driving method for display panel comprises:

dividing the display panel into n sub-regions and calculating an average gray scale value of original pixel cells in each sub-region, wherein n is an integer greater than 1; wherein the calculating an average gray scale value of original pixel cells in each sub-region comprises:

detecting the gray scale value of each original pixel cell in the sub-region; and generating the average gray scale value according to the total number of original pixel cells in the sub-region and the gray scale value of each original pixel cell;

determining a gray scale threshold value range corresponding to the sub-region according to the average gray scale value of the sub-region, when the average gray scale value is greater than a preset gray scale threshold value;

calculating a ratio of the total number of original pixel cells in the gray scale threshold value range to the total number of original pixel cells contained in the corresponding sub-region; and resetting gamma value of original pixel cell in the corresponding sub-region according to the ratio and a preset gamma value conversion relationship.

* * * * *